US009595212B2

(12) United States Patent
Jacobson

(10) Patent No.: US 9,595,212 B2
(45) Date of Patent: Mar. 14, 2017

(54) SYSTEMS AND METHODS OF PROVIDING ADJUSTABLE SIGNAGE

(71) Applicant: Neil Jacobson, Exton, PA (US)

(72) Inventor: Neil Jacobson, Exton, PA (US)

(73) Assignee: Adelphia Graphic Systems, Inc., Exton, PA (US)

( * ) Notice: Subject to any disclaimer, the term of this patent is extended or adjusted under 35 U.S.C. 154(b) by 0 days.

(21) Appl. No.: 15/091,133

(22) Filed: Apr. 5, 2016

(65) Prior Publication Data

US 2016/0217716 A1 Jul. 28, 2016

Related U.S. Application Data

(63) Continuation of application No. 14/603,113, filed on Jan. 22, 2015, now Pat. No. 9,305,468.

(60) Provisional application No. 61/981,505, filed on Apr. 18, 2014.

(51) Int. Cl.

| | |
|---|---|
| ***G09F 11/00*** | (2006.01) |
| ***G09F 7/10*** | (2006.01) |
| ***G09F 7/18*** | (2006.01) |

(52) U.S. Cl.

CPC . *G09F 7/10* (2013.01); *G09F 7/18* (2013.01)

(58) Field of Classification Search

CPC ..... G09F 7/10; G09F 3/20
USPC ..... 40/491, 611.06, 611.07, 765
See application file for complete search history.

(56) References Cited

U.S. PATENT DOCUMENTS

| | | | | | |
|---|---|---|---|---|---|
| 2,776,638 | A * | 1/1957 | Whitaker | G09B 29/00 | 116/324 |
| 2,895,448 | A * | 7/1959 | Haines | B42F 21/10 | 116/324 |
| 2,951,301 | A * | 9/1960 | Slavsky | G09F 3/203 | 40/653 |
| 4,679,341 | A * | 7/1987 | Goldman | G09F 7/10 | 40/490 |
| 5,257,595 | A * | 11/1993 | Cassidy, Jr. | G09F 7/10 | 116/281 |
| D351,423 | S * | 10/1994 | Cassidy, Jr. | D20/18 | |
| 7,415,789 | B2 * | 8/2008 | Hluchan | G09F 1/04 | 116/322 |
| 7,707,757 | B2 * | 5/2010 | Crowell | G09F 11/00 | 40/490 |
| 8,695,254 | B2 * | 4/2014 | Bell | G09F 15/00 | 116/324 |
| 9,015,975 | B2 * | 4/2015 | Blue | G09F 7/10 | 40/488 |

* cited by examiner

*Primary Examiner* — Shin Kim
(74) *Attorney, Agent, or Firm* — Dilworth Paxson LLP; Edward F. Behm, Jr.

(57) ABSTRACT

Architectural signage and the providing of systems and methods for adjustable signage suitable for operation with one hand. A signage assembly may include a slider panel assembly having a back plate and a plurality of slider portions, where each of the slider portions may include a guidance tongue formed from a portion of the back plate. The guidance tongue may include a lock button extending from a front face of the guidance tongue, wherein the guidance tongue is configured to flex in a direction perpendicular to or from a front face of the back plate to allow insertion of a slidable tab with reduced interference from the lock button, and wherein the lock button is configured to mate with a lock pocket of a slidable tab when the slidable tab is fully extended.

6 Claims, 20 Drawing Sheets

1402

SYSTEMS AND METHODS OF PROVIDING ADJUSTABLE SIGNAGE

CROSS-REFERENCE TO RELATED APPLICATION

The present application is a continuation of U.S. patent application Ser. No. 14/603,113, filed Jan. 22, 2015, now U.S. Pat. No. 9,305,468, entitled "System and Methods of Providing Adjustable Signage," which claims priority to U.S. provisional patent application to 61/981,505, filed Apr. 18, 2014, entitled "System and Methods of Providing Adjustable Signage," the contents of which are incorporated by reference in their entireties herein.

FIELD OF THE DISCLOSURE

The present disclosure relates to the providing of signage, and, more particularly, to a systems and methods of providing adjustable signage suitable for operation with one hand.

BACKGROUND

Signage has long been utilized to convey information and to provide clear indicia of the environment surrounding the signage. As signage technology has progressed, more advanced signage configurations have been introduced to convey more information. Examples of such advanced signage may be found in U.S. Pat. Pub. No. 2013/0192107 to Blue et al., titled "Messaging Sign Having a Reversible Fastening System for Moveable Display Articles," filed Jun. 18, 2013 and U.S. Pat. No. 8,127,478 to Blue et al., titled "Messaging Sign Having a Reversible Fastening System for Moveable Display Articles," issued Aug. 1, 2013, each of which are incorporated by reference in their entireties herein.

While advanced signage includes a plurality of moveable display articles that allow the display of multiple indicia in addition to the primary signage content, the configuration for the moveable display articles may require the usage of resilient members interlocking with a plurality of position notches manufactured into the movable member. While this may provide an initially secure connection, repeated use of the movable member may diminish the pliancy of a resilient member, causing instability to the movable member assembly. Also, notched members are known to "catch" within the resilient member, which may make extension and/or retraction of the moveable member difficult. Often times, such configurations require two hands to operate easily.

Accordingly, there exists a need for providing of signage with improved movable member mechanisms that are easier to manufacture, provide relatively consisted stability and provide adjustable signage suitable for operation with one hand.

SUMMARY

The present disclosure relates to architectural signage and the providing of systems and methods for adjustable signage suitable for operation with one hand. It is to be understood that both the foregoing general description and the following detailed description are exemplary and explanatory, and are intended to provide further explanation of the invention as discussed hereinthroughout.

In one exemplary embodiment, a signage assembly is disclosed, comprising a slider panel assembly comprising a back plate; and a plurality of slider portions, each of the slider portions comprising a guidance tongue formed from a portion of the back plate, the guidance tongue comprising a lock button extending from a front face of the guidance tongue, wherein the guidance tongue is configured to flex in a direction perpendicular to or from a front face of the back plate to allow insertion of a slidable tab with reduced interference from the lock button; and wherein the lock button is configured to mate with a lock pocket of a slidable tab when the slidable tab is fully extended. The guidance tongue may be formed from a portion of the back plate by routing an opening in the back plate on a portion of a periphery surrounding the guidance tongue. A face plate may cover a front face of the back plate, wherein the guidance tongue is configured between the face plate and back plate.

In another exemplary embodiment, a method is disclosed for configuring a signage assembly, comprising: providing a slider panel assembly comprising a back plate; providing a plurality of slider portions, each of the slider portions comprising a guidance tongue; forming the guidance tongue from a portion of the back plate wherein the guidance tongue is configured to flex in a direction perpendicular to or from a front face of the back plate to allow insertion of a slidable tab with reduced interference from the lock button; and forming a lock button extending from a distal end of a front face of the guidance tongue, wherein the lock button is configured to mate with a lock pocket of a slidable tab when the slidable tab is fully extended.

BRIEF DESCRIPTION OF THE DRAWINGS

The accompanying drawings are included to provide a further understanding of the disclosed embodiments. In the drawings, like numerals represent like elements, and.

DETAILED DESCRIPTION

Figure 1:
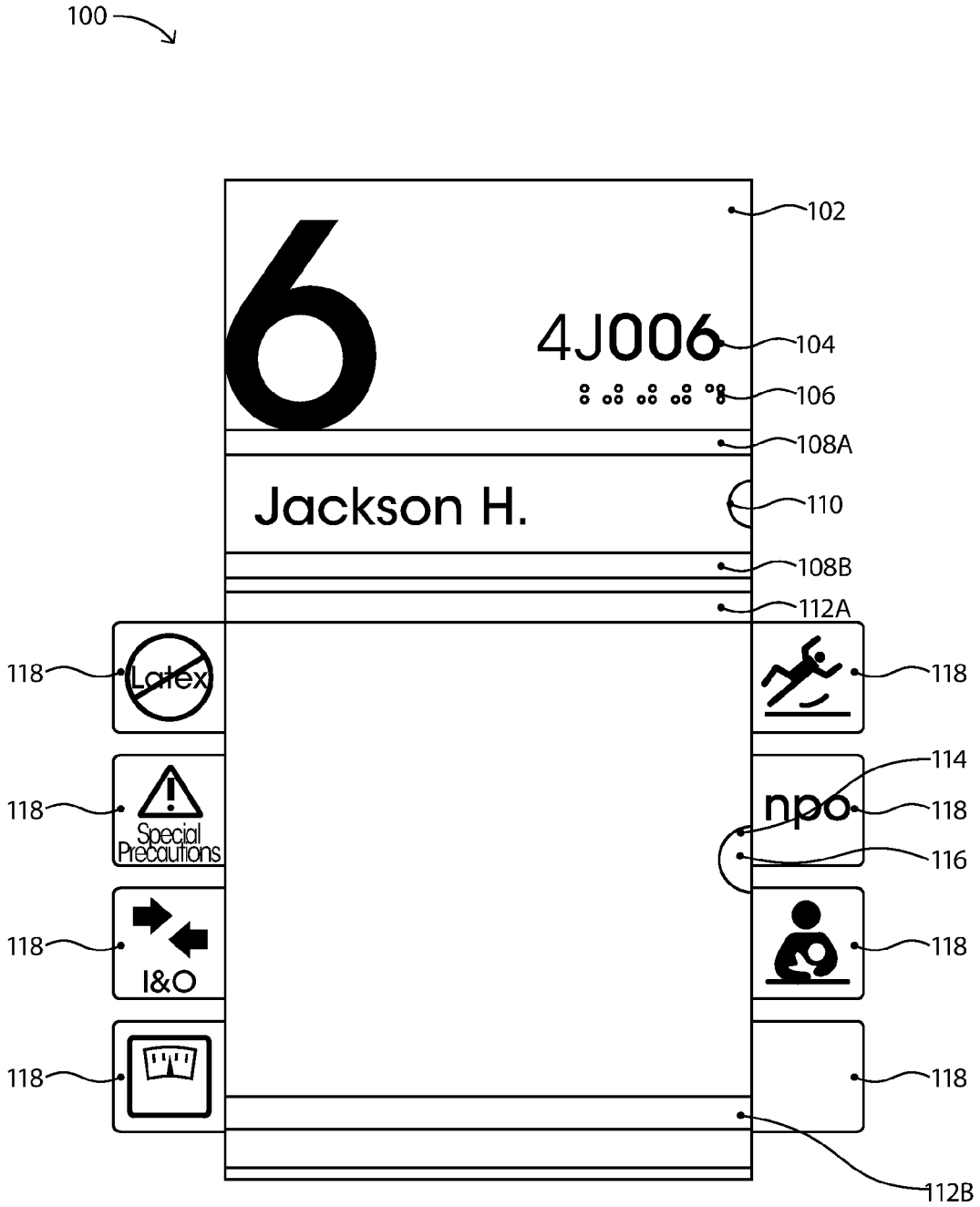
FIGS. 1-1B illustrate various embodiments of signage panel assemblies comprising one or more insert windows and a plurality of slidable tabs covered by a door insert window, where a hinge body allows access to at least one portion of a panel.

Exemplary embodiments will now be described more fully with reference to the accompanying drawings.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms and that neither should be construed to limit the scope of the disclosure. In some exemplary embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Various embodiments will be described herein below with reference to the accompanying drawings. In the following description, well-known functions or constructions are not described in detail since they may obscure the invention in unnecessary detail. Furthermore, while specific numbers relating to measurements, distances and or dimensions may be provided, it should be clearly understood that the provided numbers are for illustrative purposes only, and that a multitude of other measurements, distances and or dimensions are applicable depending on the needs of the designer. Similarly, while specific materials may be described for components, other similar or different materials may be utilized as well.

In signs, an image may be used to convey a message of the sign. Some, like statutory sign pictograms, follow very specific set of color, shape and sizing rules. For example, an image that identifies a room or space (such as a gender image on a restroom signs), must follow specific rules. Other signs that must comply with rules such as those associated with the ADA Accessibility Guidelines. Similarly, medical institutions, and in particular hospitals, often require specific signage and flexible use signage which may allow a sign to be manipulated to fit a specific application. For example, a sign outside a patients room may be capable of being manipulated by at least one user to reflect information pertinent to the patient and/or the room.

For a sign to be effective it should be instantly recognizable and understood by all. For this to work the image must be kept consistent. In its purest form a sign should be understood even if there is no text present. Following the standard color and shape rules increase the likelihood of a universally understood pictogram and therefore sign.

In general, signs can be classified into the following functions: (a) Information: signs giving information about services and facilities, e.g., maps, directories, instructions for use, etc. (b) Direction: signs leading to services, facilities, functional spaces and key areas, e.g., sign posts and directional arrows; (c) Identification: signs indicating services and facilities, e.g., room names & numbers, toilet signs, and number of floors; and (d) Safety and Regulatory: signs giving warning or safety instructions, e.g., warning signs, traffic signs, exit signs, and rules and regulations.

An example of the use of shape to convey different meanings can be found in transportation signs where rectangular signs are often used to portray general information to an audience. They tell where something is, what something is, and similar information. In contrast, a circular sign represents an instruction that must be followed. Both the mandatory and the prohibition signs provide instructions that cannot be ignored. Further, a triangle may represent a warning sign and may be used to convey danger or caution. Such a sign may also provide information but its primary purpose it to quickly tell you to be aware and careful.

As illustrated in the attached Figures, the present disclosure may allow for the use of any dimension and/or shape sign and may further include at least one flag and/or secondary signage which may provide information to a passerby when displayed. In an embodiment of the present invention, the at least one flag and/or secondary signage may be incorporated into at least a portion of the sign and may be associated with the frame of the sign. In this way, information may be quickly and easily displayed and hidden with respect to the signage as the user wishes. The use of such semi-permanent signage may allow for the rapid changing of displayed information.

Turning to FIG. 1, an exemplary embodiment of a signage panel assembly 100 is shown, comprising header panel 102 which may include visual indicia 104, which, in the shown example includes a floor number ("6") and a room number ("4J006"). In one embodiment, header panel 102 may comprise tactile indicia 106, such as raised Braille, or other similar tactile indicia. Alternately or in addition, further indicia may be provided for header panel 102 including bar codes, QR codes and even RFID tags. Insert window 110 comprising top and bottom margins 108A, 108B may further be provided, where insert window may be configured to receive name plates or other content. Insert window may be manufactured from acrylic or other suitable material and comprise finger notch for easier insertion of content.

Continuing with the exemplary embodiment, signage panel assembly may comprise a door insert window assembly 114 on a bottom portion comprising a finger notch and secured by margins 112A, 112B, of a double insert window. Door insert window assembly may comprise an acrylic material overlapping an insert door 116, which may be manufactured from galvanealed steel, aluminum, or other suitable material. Slidable tabs 118 may be provided as movable members for providing supplementary signage content/information as shown. Each of sliding tabs 118 may be configured to display different information as needed, or may be left blank.

Figure 1A:
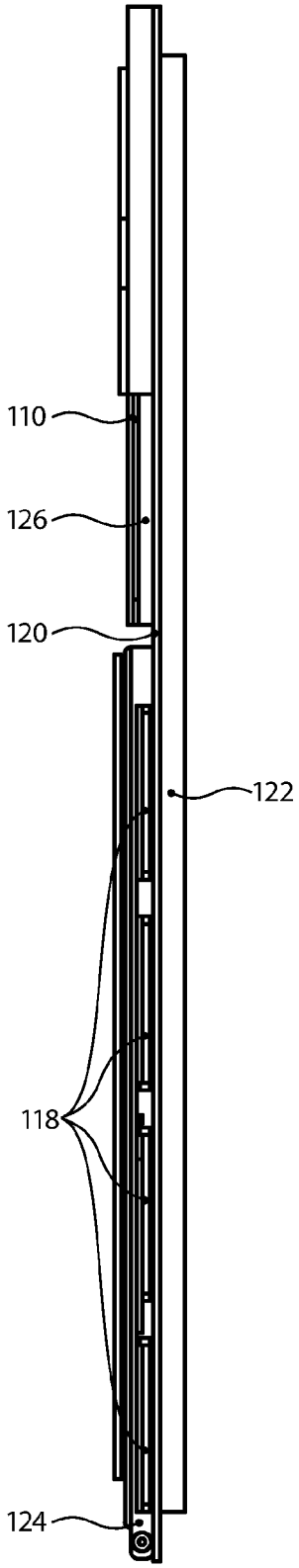
Figure 1B:
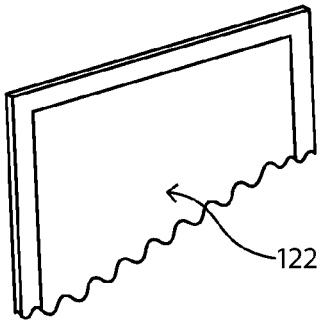

Turning to FIG. 1A, a side view of signage assembly panel 100 is illustrated under one embodiment. Insert window 110 may be assembled over backing material 126, which may comprise an adhesive foam or other suitable material, and backer plate 126, which may be manufactured from steel, aluminum, or other suitable material. The rear of signage assembly panel 100 may further comprise a rear backer panel 122 that may be affixed to a front portion of signage assembly panel 100 or configured to be hinged therefrom via hinge 124. Rear backer panel may be manufactured from plastic, polyvinyl chloride, Sintra, metal, or any other suitable material.

Figure 2:
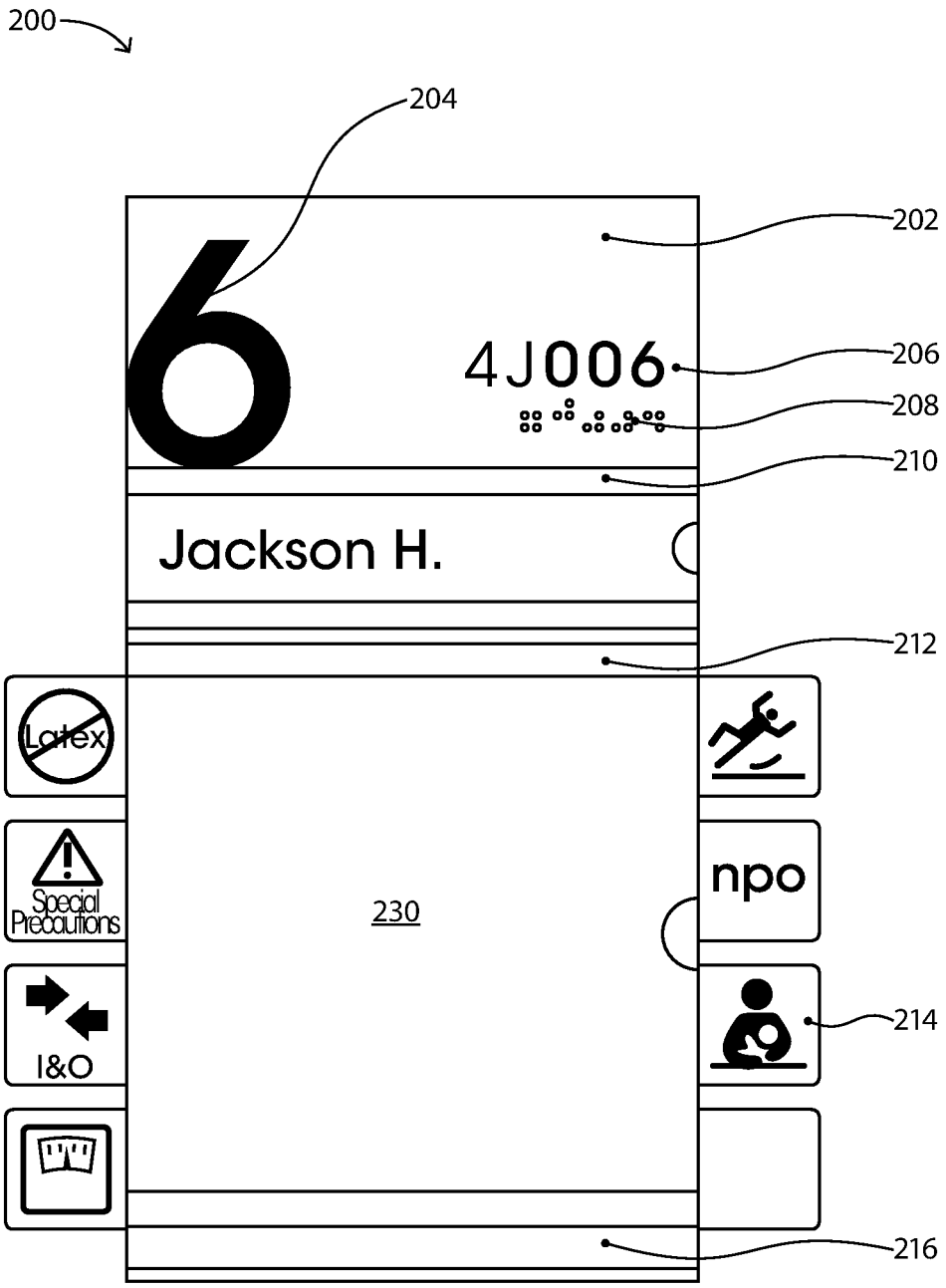
FIGS. 2-2A illustrate other various embodiments of signage panel assemblies comprising one or more insert windows and a plurality of slidable tabs covered by a door insert window.

Turning to FIG. 2, another exemplary embodiment of a signage panel assembly 200 is shown, comprising header panel 202 which may include visual indicia 204, which, in the shown example includes a floor number 204 and a room number 206. In one embodiment, header panel 202 may also comprise tactile indicia 208, such as raised Braille, or other similar tactile indicia (e.g., raster beads). Alternately or in addition, further indicia may be provided for header panel 202 including bar codes, QR codes and even RFID tags, similar to the embodiment in FIG. 1. Insert window 210 comprising top and bottom margins may further be provided, where insert window may be configured to receive name plates or other content. Insert window may be manufactured from acrylic or other suitable material and comprise finger notch for easier insertion of content.

Continuing with the exemplary embodiment, signage panel assembly may comprise a door insert window assembly 230 on a bottom portion comprising a finger notch and secured by top and bottom strips 212. Door insert window assembly 230 may comprise an acrylic material overlapping an insert door, which may be manufactured from galvanealed steel, aluminum, or other suitable material. Slidable tabs 214 may be provided as movable members for providing supplementary signage content/information as shown. Each of sliding tabs 214 may be configured to display different information as needed (see, e.g., FIG. 14B-15), or may be left blank. Door insert assembly 230 may be coupled to slider panel assembly 216 which may comprise routed slide slots to accept panel 230 and pockets (as can be seen in FIG. 2A) for accepting slidable tabs 214.

Figure 2A:
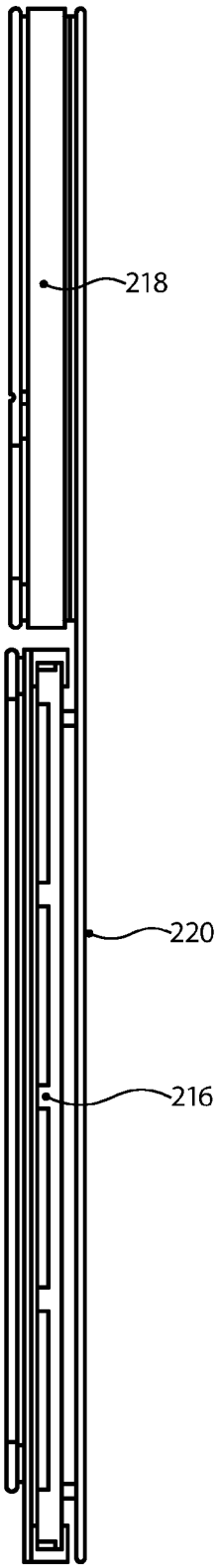

Turning now to FIG. 2A, a side view of signage assembly panel 200 is illustrated under one embodiment. Insert window 202 may be assembled over backing material 218, which may comprise an adhesive foam, tape or other suitable material, and backer plate 220, which may be manufactured from steel, aluminum, or other suitable material. Slider panel assembly 216 may be sandwiched among insert panel 212 and backing material 218. As will be discussed in further detail below, slider panel assembly is configured to hold and secure slidable tabs under various embodiments.

Figure 3A:
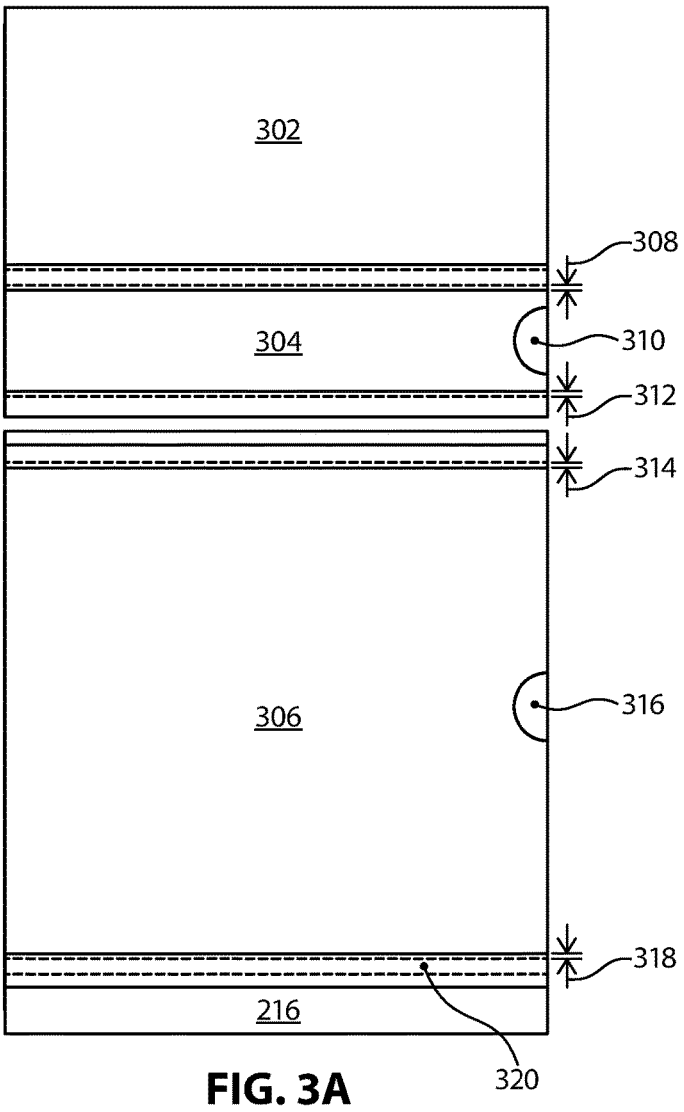
FIGS. 3A-3C illustrate embodiments of panel assembly portions and backings.
Figure 3B:
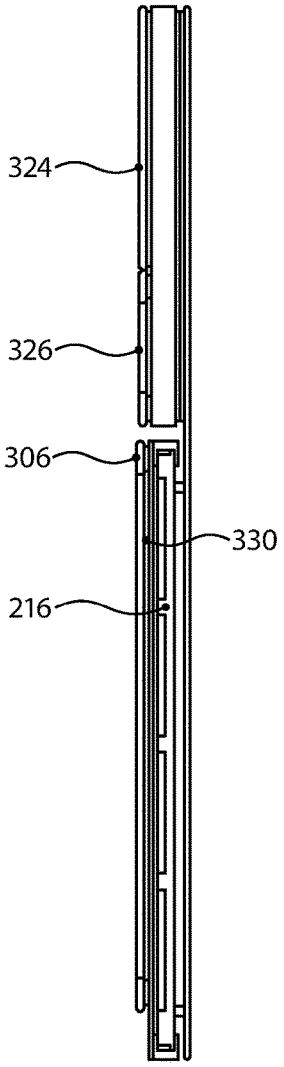

FIGS. 3A and 3B provide exemplary embodiments of backing portions of signage panel assemblies of FIG. 1 or FIG. 2, where portion 302 comprises a backing which may be manufactured from adhesive foam tape or other suitable material. Foam tape (320) may be also applied above gaps 308 and 314 and below gaps 312 and 318. Insert backing 304, comprising thumbslot 310 may be configured between foam tape 308, 312, while opening window 306 for door insert assembly 230, along with thumb slot 316 is positioned as show in FIGS. 3A and 3B. As can be seen from FIG. 3B, header panel 324 may be affixed to backing 302 via adhesive, tape, or other suitable means. Similarly, insert panel 326 may be affixed to backing 304. Opening window 306 may comprise a clear acrylic panel and is laid over and affixed to insert pocket 330, which may include a storage slot for receiving signage content inserts. Slider panel assembly 216 may be positioned as shown to hold slidable tabs as discussed herein.

Figure 3C:
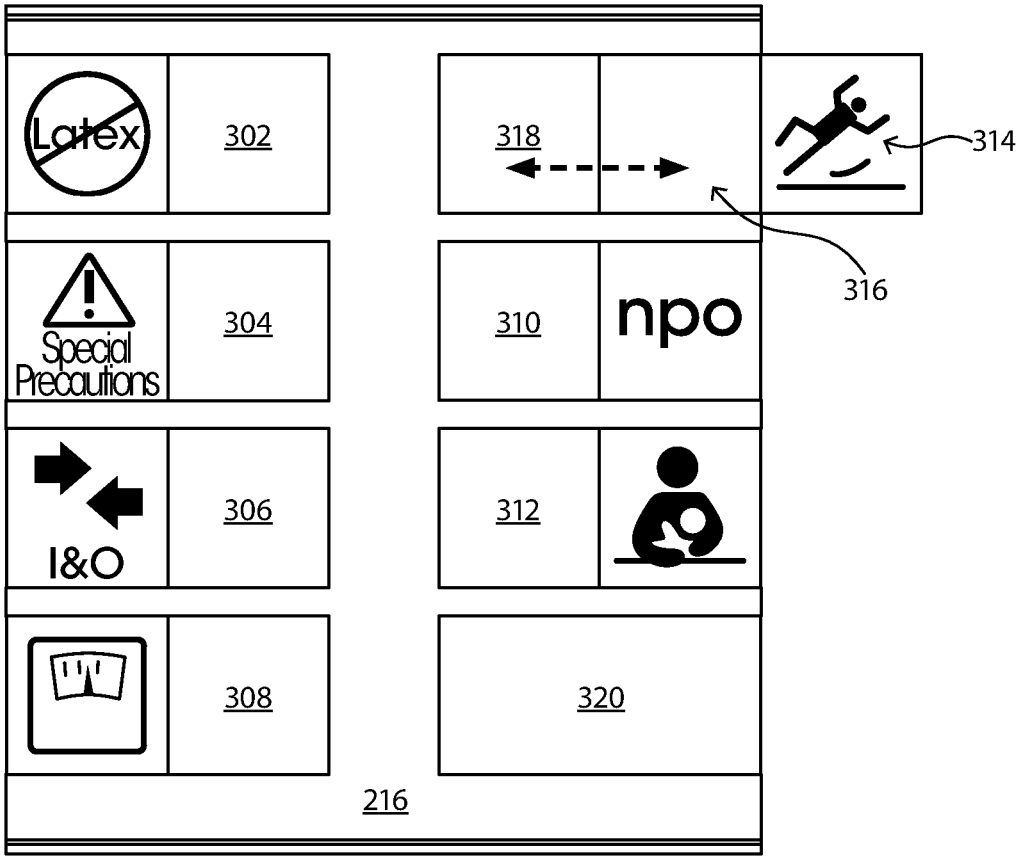

FIG. 3C illustrates an exemplary slider panel assembly 216 accommodating slidable tabs 302-314. As can be seen in the illustrative figure, each tab may be configured with different content to visually communicate different information. The slidable tabs may be configured to move laterally as shown by the dashed arrow in the figure, and each tab preferably comprises a content portion 314 and an empty portion 316, as empty portion 316 will typically be covered by a door insert window assembly 114, 230 when a signage assembly panel is fully assembled.

Figure 4:
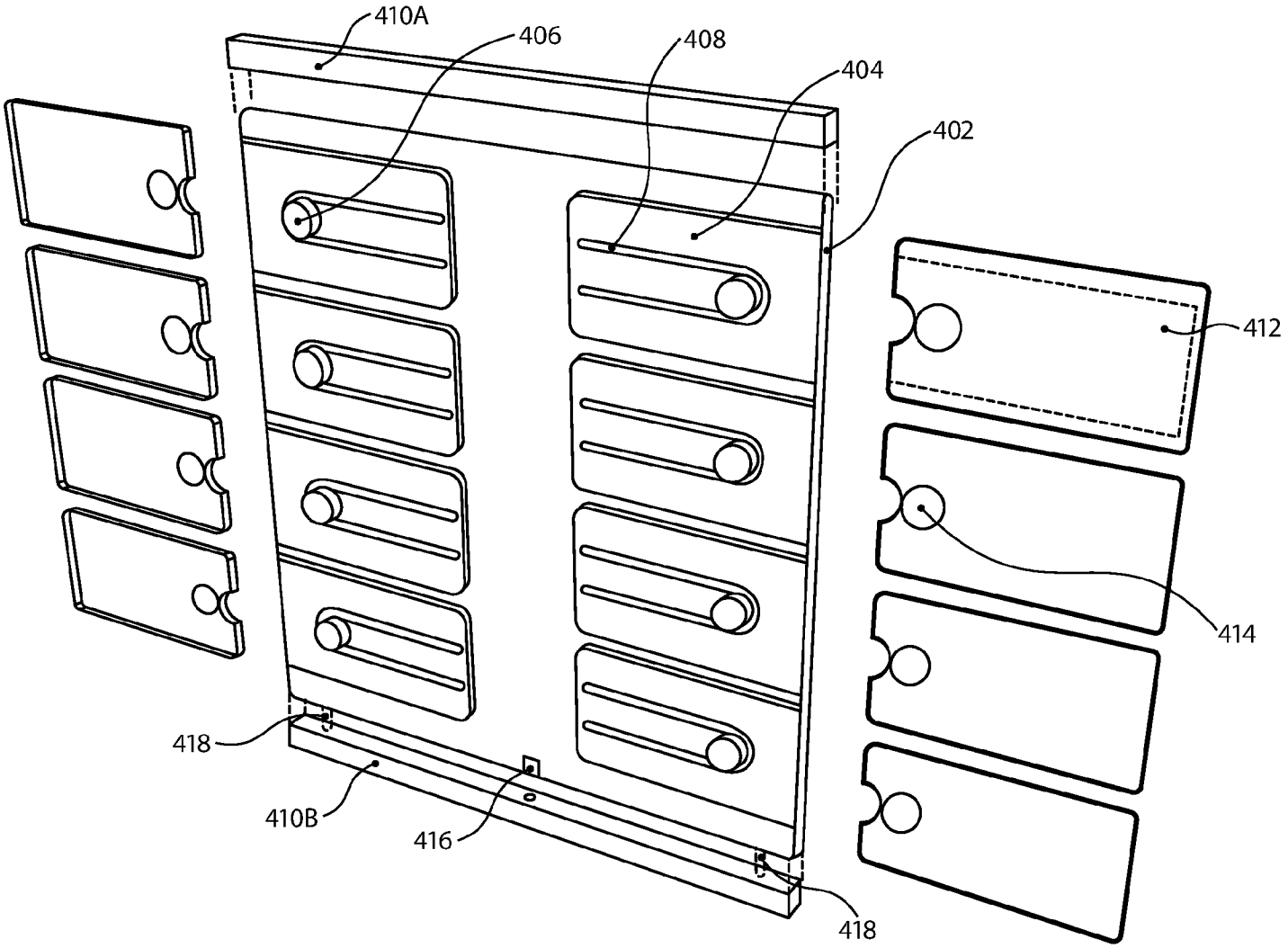
FIG. 4 illustrates an exemplary embodiment of a back plate assembly configured to receive a plurality of insert tabs securable by lock buttons affixed to a grooved tongue.

FIG. 4 illustrates an exemplary embodiment of a slider panel assembly comprising back plate 402 and a plurality of slider pockets 404 comprising securing/guidance tongues 408 comprising lock buttons 406. In one exemplary embodiment, pockets 404 may be routed out of the backplane to create an area suitable for receiving slidable insert tabs 412. The edges along each elongated side of pockets 404 may be machined smooth as shown. Alternately, the edges along each elongated side of pockets 404 may be grooved, while the elongated edges of slidable insert tabs 412 are machined to comprise a tongue, so that the tabs 412 join pockets 404 in a tongue-and-groove fashion. Of course, pockets 404 may be configured with a tongue while tabs 412 comprise a groove to achieve a similar result. Tabs 412 may also be further routed or milled on an inner face (i.e. the side facing back plate 402, shown as dotted lines for tab 412) to provide a guidance edge to allow tab 412 to slide along a guiding edge when coupled with pocket 404. Similarly, the sliders may comprise a dovetail or rabbit arrangement.

Tabs 412 may comprise lock pocket 414 that engages with lock button 406 to secure tab to tongue 408 and, in turn, to back plate 403. Routing out tongue 408 within back plate 403 provides tongue 408 with resilience that allows tongue to flex while providing resistance in a direction perpendicular to the face of back plate 403. Accordingly, tongue 408 posses enough flex to allow insert tab 412 to be easily moved without interference from lock button 406 before lock button 406 locks tab 412 into place when it is fully extended. By pressing tab 412 in the direction of back plate 402, lock pocket 414 lifts away from back plate 402 allowing it to disengage at least partially from lock button 406, which then allows tab 412 to be slid back into a retracted position.

Continuing with the example in FIG. 4, back plate 402 comprises a lower assembly portion 416 comprising a press fit body spring plunger and steel ball that may be drilled into the base of back plate 402, which allows the face plate to slide from side to side while holding it in place to the overall assembly. Lower assembly portion 416 may be configured to be mated with a bottom U-channel 410B via securing mechanism 418 which may comprise a nylon hex socket flat point set screw. The channel for U-channel 410B may be formed by routing the channel out of an acrylic or other material, where holes may be drilled to accept securing mechanism 418. Upper U-channel 410A may be configured in a similar manner. Further details of back plate 402 integration into an assembly will be described in further embodiments described below.

Figure 5B:
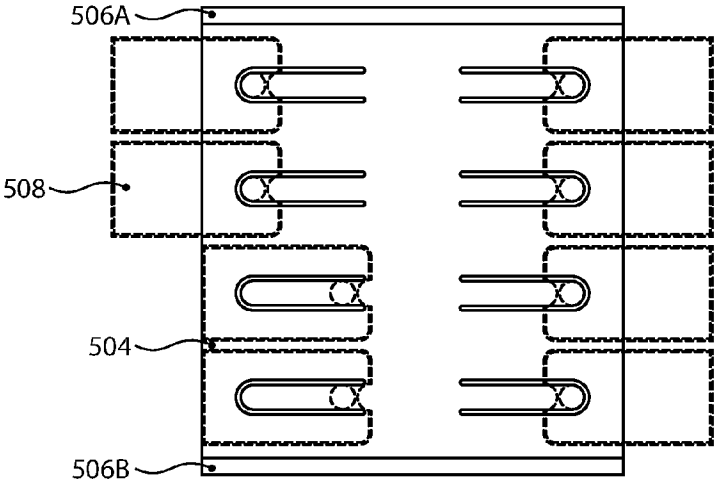
FIGS. 5-5C shows other embodiments illustrating a front, side, black and plan views of a back plate assembly having attached insert tabs.
Figure 5A:
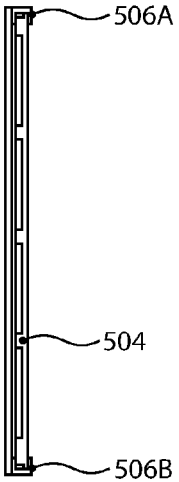
Figure 5:
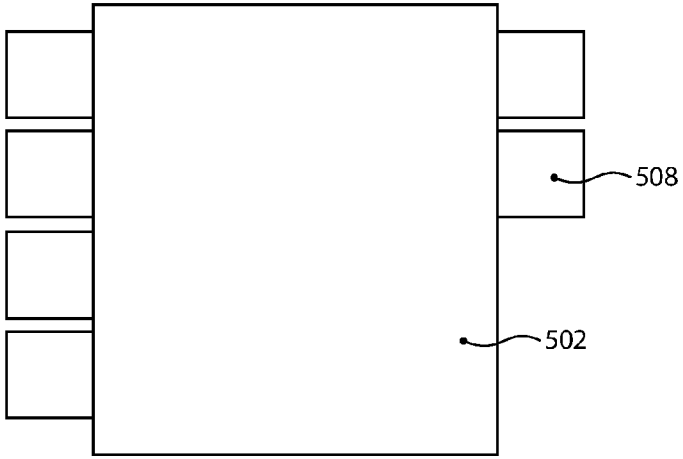
Figure 5C:
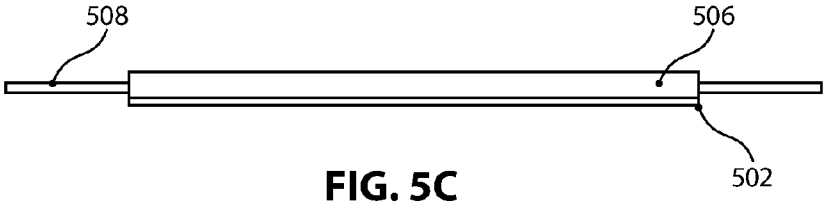
Figures 6A, 6B, 6C:
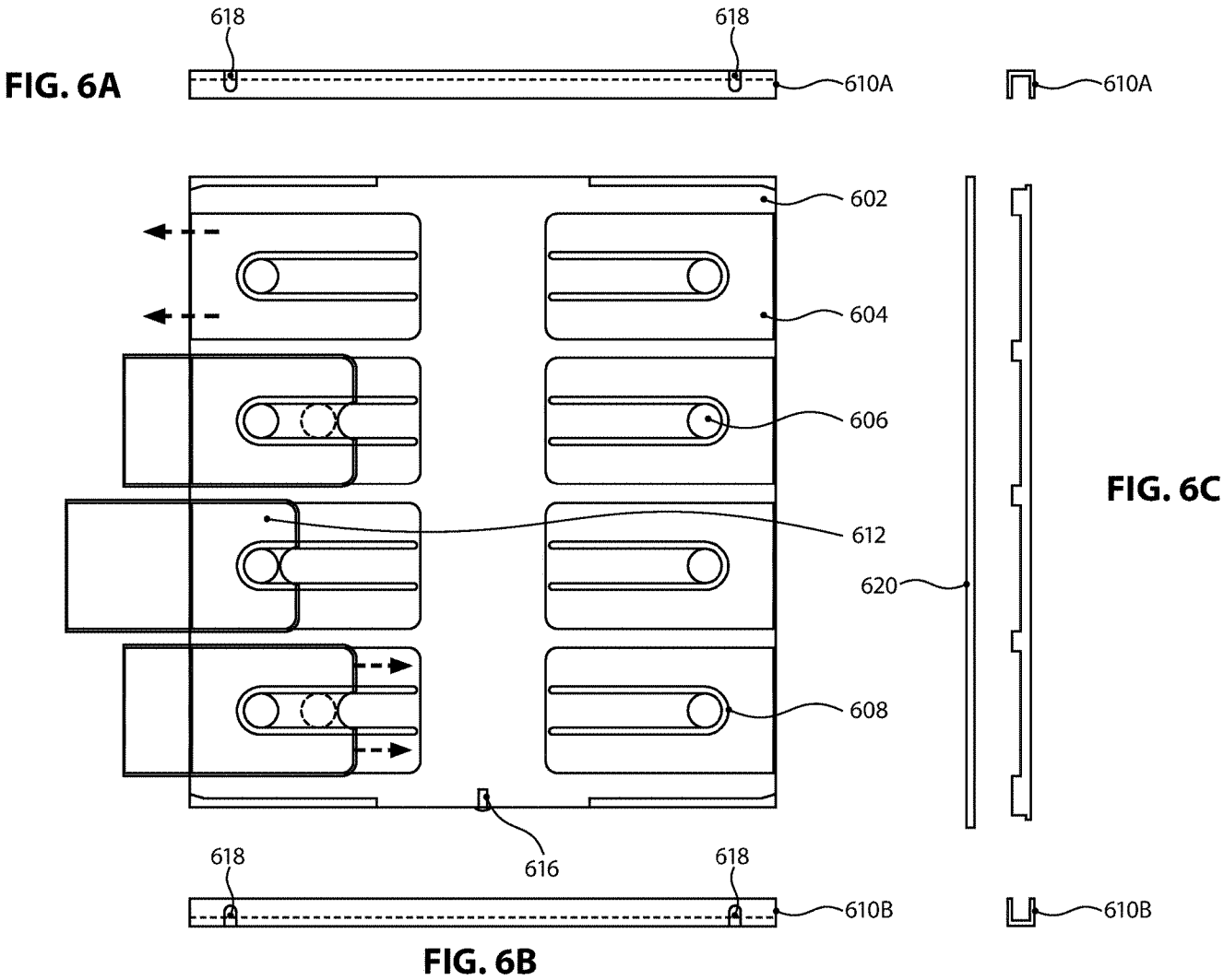
FIGS. 6A-6G show other embodiments illustrating a front, side, black and plan views of a back plate assembly having attached insert tabs, together with u-channel assemblies, tab assembly and back plate tongue arrangement.
Figure 6D:
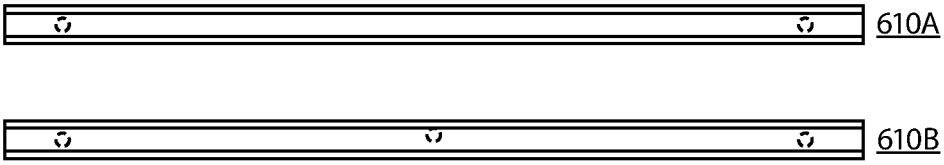
Figure 6E:
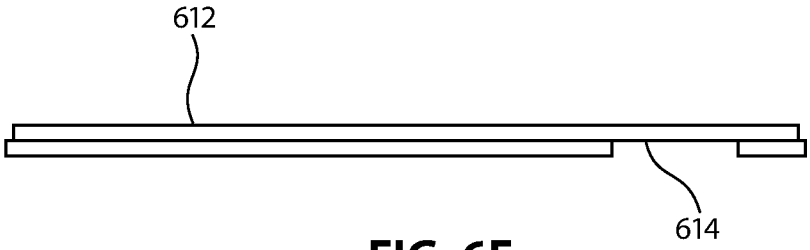
Figure 6F:
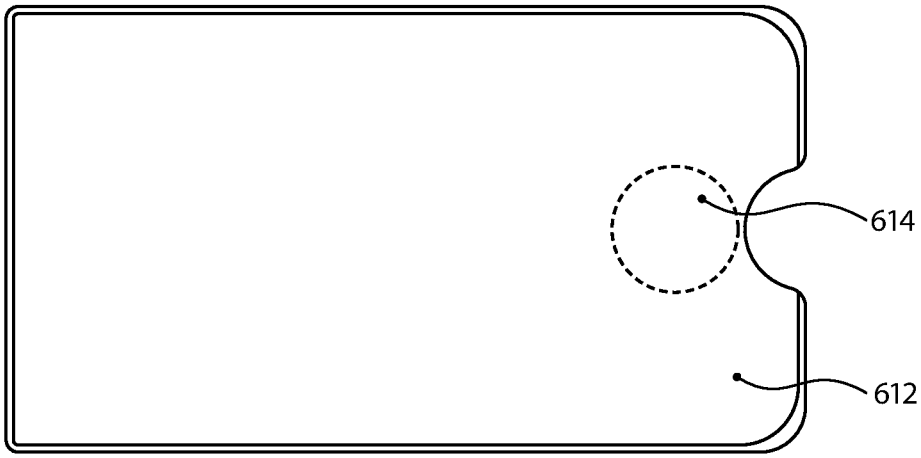
Figure 6G:
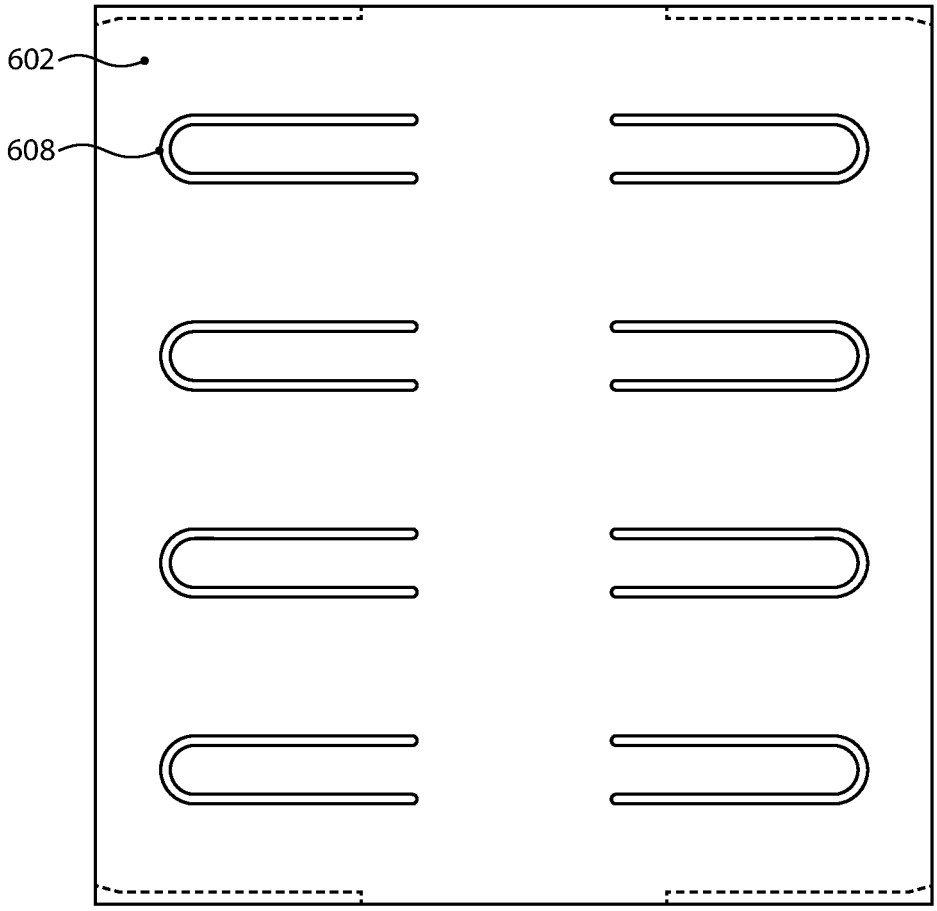

Turning now to FIGS. 5-5C, back plate 402 may be assembled with face plate 502 that covers back plate 402, where tabs 508 may be extended and retracted in a similar manner to that disclosed above. A front, side, back and plan view of an exemplary assembly is provided in the figures. As can be seen, top and bottom U-channels 5A-5B are shown in an assembled configuration to back plate 504. Back plate 504 may comprise routed grooves, pockets and slots on a front surface of the material to accept top and bottom U-channels and insert tabs as discussed herein. Top 506A and bottom 506B U-channels may comprise acrylic material with routed slots to cap over back plate 402 w/ drilled holes to accept fasteners/securing mechanisms. Insert tabs 508 may comprise an acrylic material cut and routed to shape, where graphics may be applied or digitally printed to a front surface. As can be seen from FIG. 5C, face plate 502 may be fused to the face of top and bottom U-channels (506).

FIGS. 6A-6G illustrate further exemplary embodiments of the disclosed signage panel assembly comprising back plate 602, pockets 604, lock buttons 606, tongue 606 with groove 608, top 610A and bottom 610B upper (610A) and lower (610B) U-channels, insert tabs 612, insert tab lock pockets 614, back plate fastener 616 (e.g., body spring plunger), backplane hardware 618 (e.g., hex socket flat point set screw) and faceplate 620.

Figure 7A:
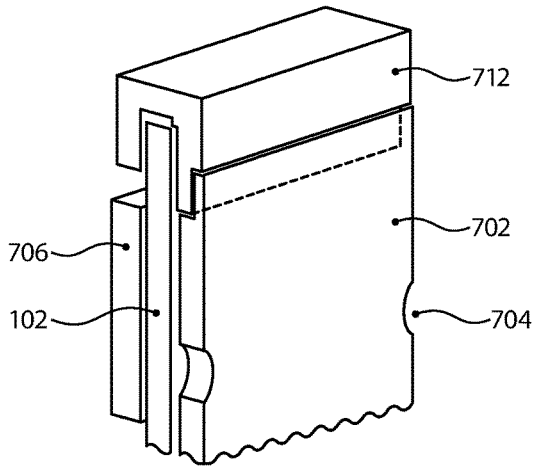
FIGS. 7A-7D illustrate exemplary embodiments for assembling a panel face comprising a finger slot to a base panel utilizing u-channels.
Figure 7B:
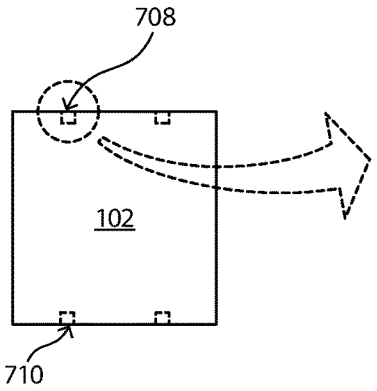
Figure 7C:
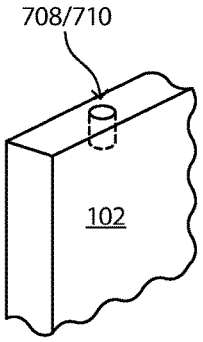
Figure 7D:
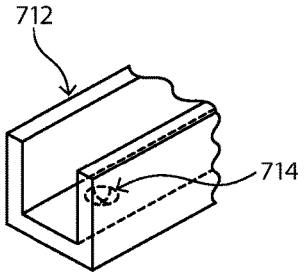
Figure 8A:
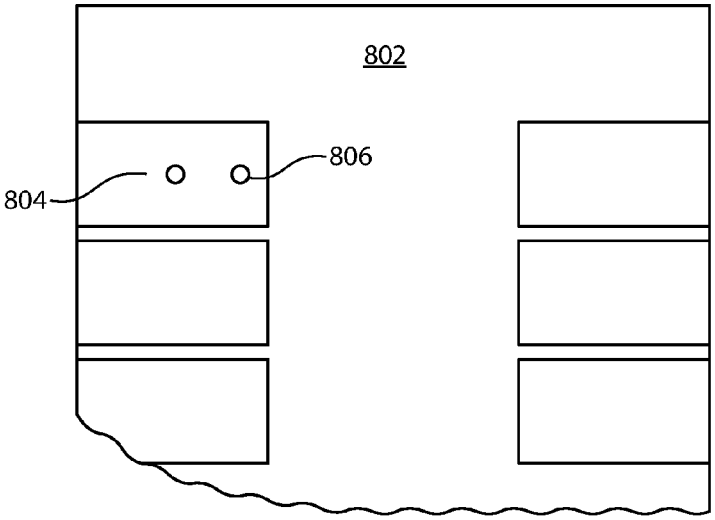
FIGS. 8A-8E illustrates another exemplary embodiment for a back plane configured to receive a plurality of moveable tabs secured by clinching studs.
Figure 8B:
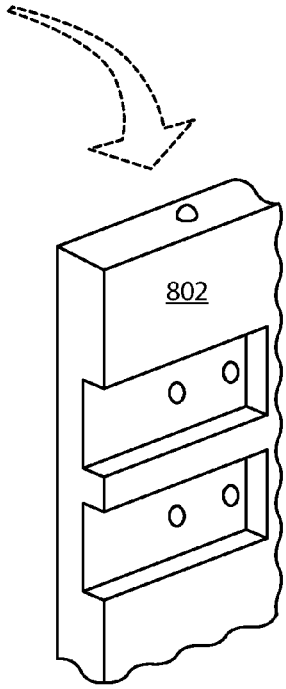
Figure 8C:
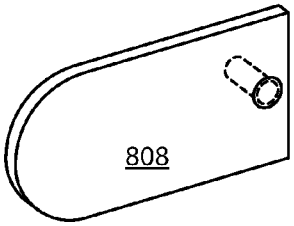
Figure 8D:
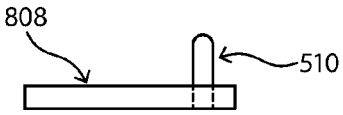
Figure 8E:
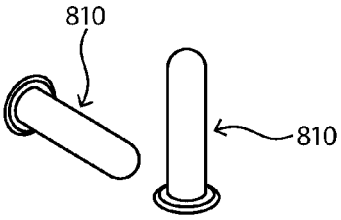

FIGS. 7A-7D illustrate aspects of a U-channel assembly as described elsewhere herein, where, in the exemplary embodiment of FIG. 7A, U-channel 712 is illustrated covering base panel 102, where U-channel 712 comprises a notched portion allowing face plate 702 with finger slot 704 to be inserted flush with a front face of U-channel 712. Spacer 706 may be provided to provide spacing between base panel 102 and other components of a signage panel assembly. In the embodiment of FIG. 7B, base panel 102 is configured with top 708 and bottom 710 seat plungers to be coupled with scoop 712, which may be configured as a ball milled scoop 714 in U-channel 712.

In the embodiments of FIGS. 8A-8E, another exemplary embodiment is provided for another back plate 802 configuration comprising pockets 804 for receiving a plurality of tabs 808. In contrast to the embodiments provided in FIGS. 4-6G, pockets 804 are configured with holes 806 configured to receive clinching studs 810 of slidable tab 808. While two holes 806 are illustrated in the figure (e.g., one for a closed position, one for an open position), it is understood by those skilled in the art that additional holes may be added to accommodate further slidable tab 808 positions.

Figure 9A:
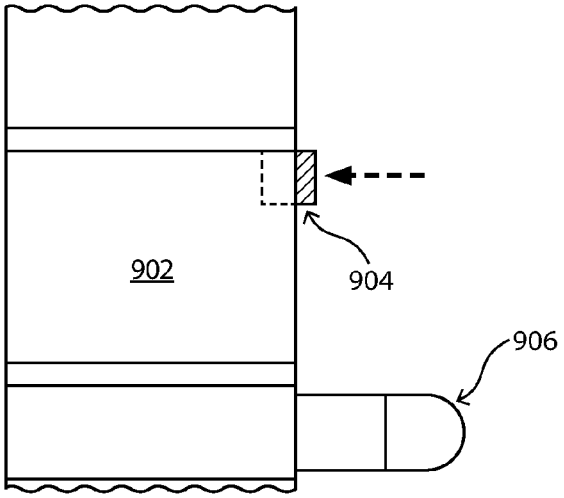
FIGS. 9A-9B illustrate another exemplary embodiment of a slidable tab.
Figure 9B:
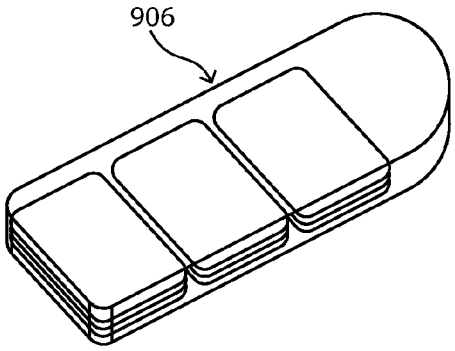

Turning to FIGS. 9A-9B, an exemplary embodiment is provided for [NEED ADDITIONAL DETAILS AS TO WHAT FIGURE IS SHOWING]

Figure 10E:
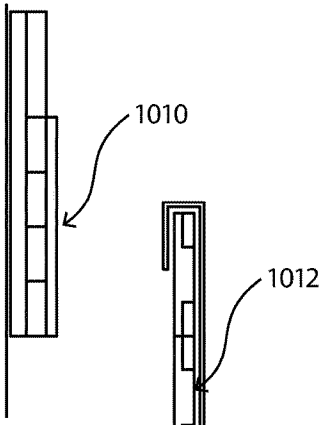
FIGS. 10A-10G illustrate various embodiments of a signage assembly comprising recessed slot sliders for receiving slidable tabs, wherein the slidable tabs may be moved from side-to-side manually or with the assistance of a magnetized implement.
Figure 10D:
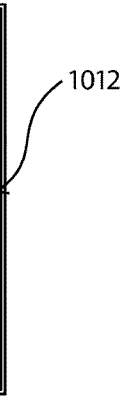
Figure 10F:
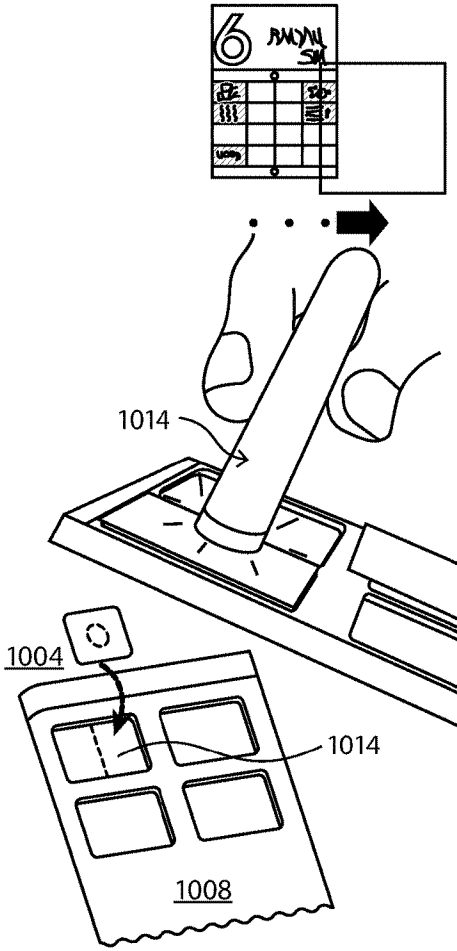
Figure 10C:
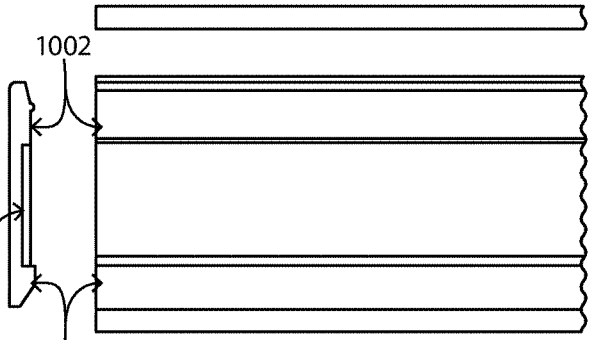
Figure 10B:
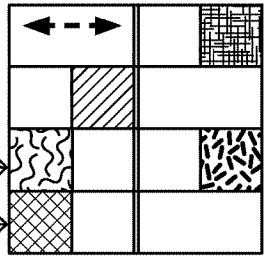
Figure 10A:
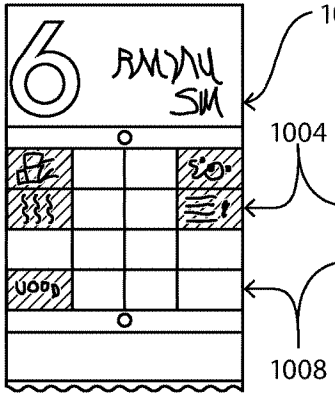

Turning to FIGS. 10A-10G, other signage panel assembly configurations are disclosed under various embodiments, where, in the examples of FIGS. 10A-10E, back plate assembly 1008 is configured to receive slidable tabs 1004 that may be covered with an overlay that may comprise color bands. Tabs 1004 may be configured to slide laterally as shown in the dotted line. As can be seen in FIGS. 10B-10C, back plate assembly 1008 may be configured with recessed edges. Looking at a back plate assembly row, a row portion may be recessed 1000, having edges 1002 in order to provide a mating, slidable surface for engaging a slidable tab. In the exemplary embodiment of FIG. 10D, it can be seen how slidable tab 1012 engages to a surface of a back plate assembly. In FIG. 100 it can be seen how a cover 1010 or overlay is positioned over the tabs.

Figure 10G:
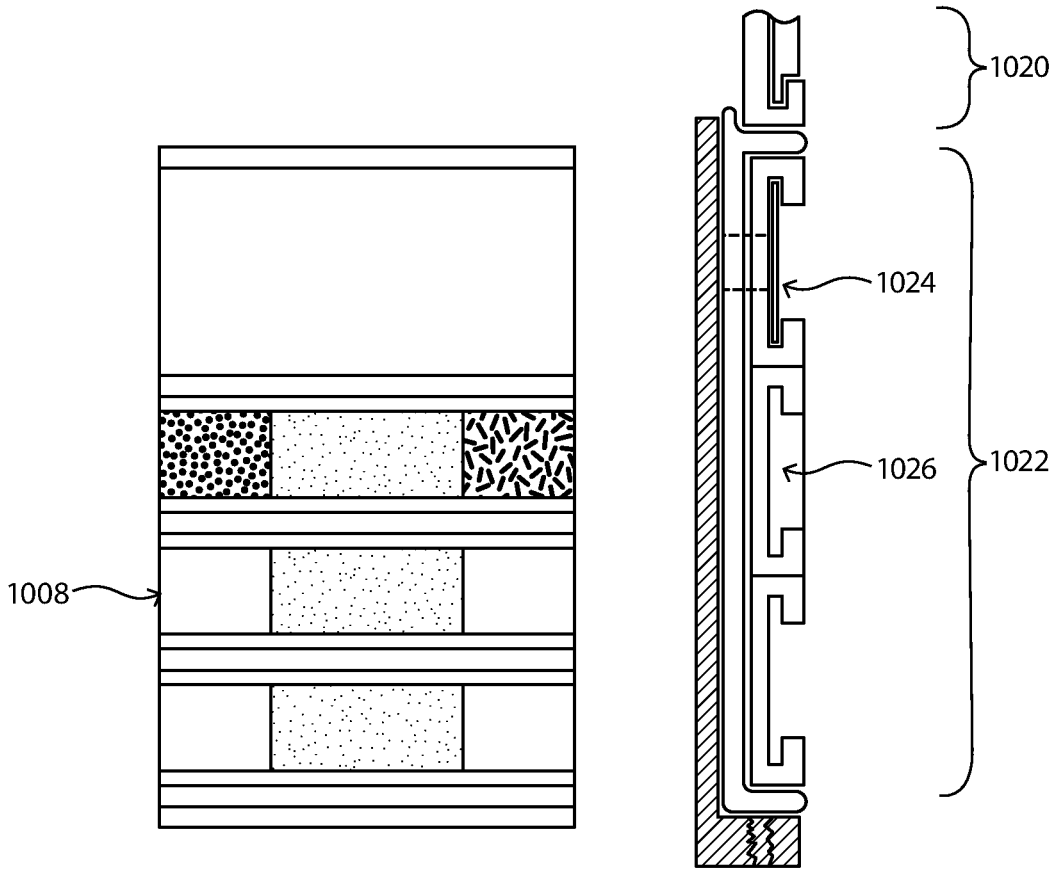

Turning to FIG. 10F, back plate assembly 1008 here is configured with recess portions 1014 adapted to receive slidable tab 1004 to allow tab to be moved laterally within its own recess portion. As can be seen in the figure, tabs 1004 may be magnetized so that they may be moved more easily by hand using magnetic implement 1014. FIG. 10G illustrates an exemplary side view, where a back plate assembly is positioned beneath header portion 1020, where the back plate assembly comprises a removable set of tabs 1022, where each tab 1024 may be positioned within each recess 1026. The removable tabs 1022 may be accessed at a read portion of the back plate assembly, via a removable plate that may also be hinged, as disclosed below in connection with the exemplary embodiment of FIG. 12.

Figures 11A, 11B:
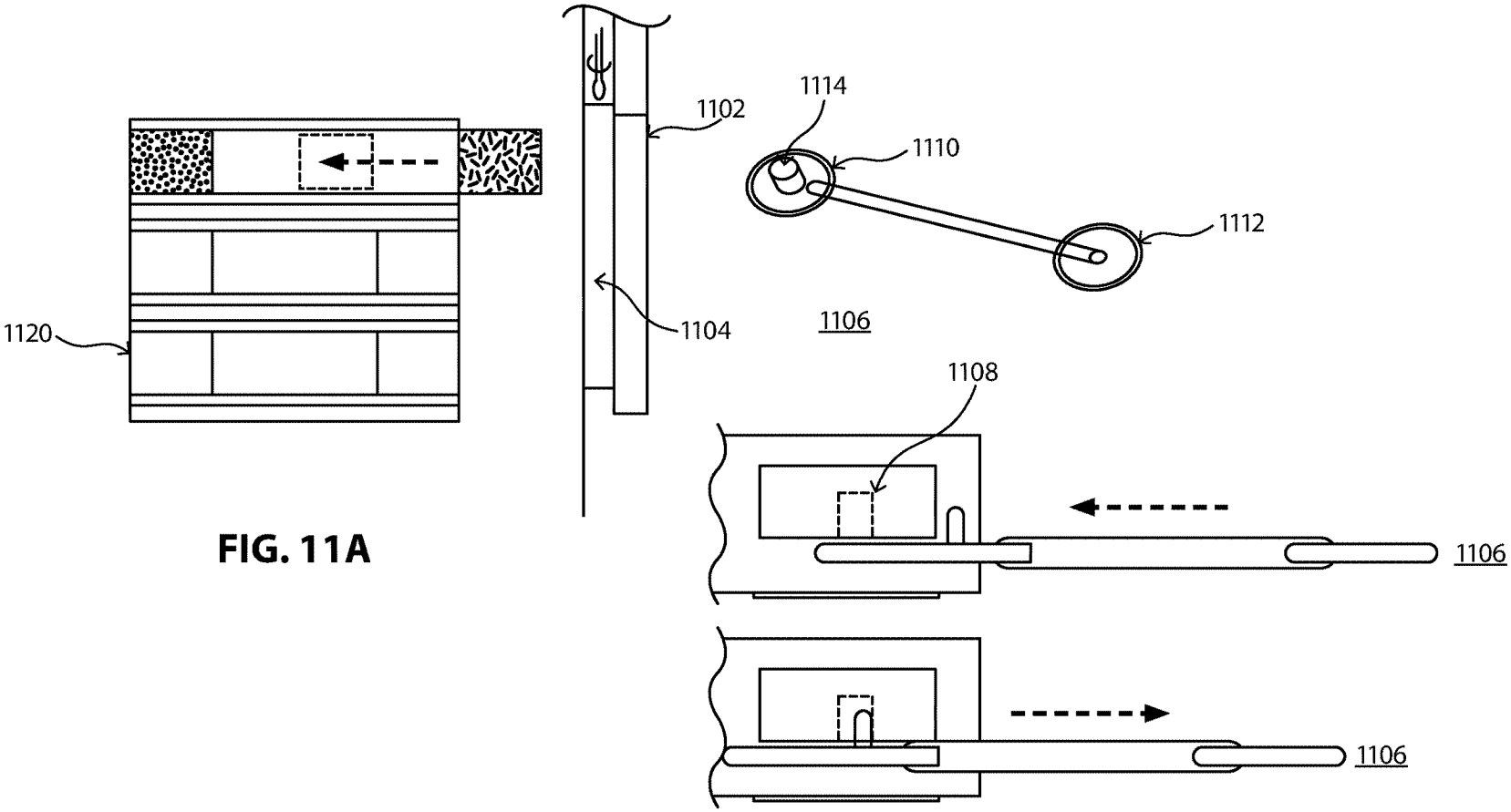
FIGS. 11A-11B illustrate various embodiments of a signage assembly comprising laterally secured sliders for receiving slidable tabs, wherein the slidable tabs may be moved from side-to-side using an implement having an end comprising a protrusion.

FIG. 11 illustrates another exemplary embodiment of a back plate assembly 1120, where slidable tabs 1102 may be configured with a tool pocket 1108 that extends into an inner surface of tab 1102. Tool 1106 is configured with a grip end 1112 and tab moving end 1110 comprising a tab extension 1114. When tool 1106 is inserted into an opening 1104 underneath tab 1102, the tab extension may be used to push in a tab by exerting a lateral force on an end of tab 1102 using tab extension 1114. Also, by mating tab extension 1114 into tool pocket 1108, tab 1102 may be pulled out as well.

Figure 12B:
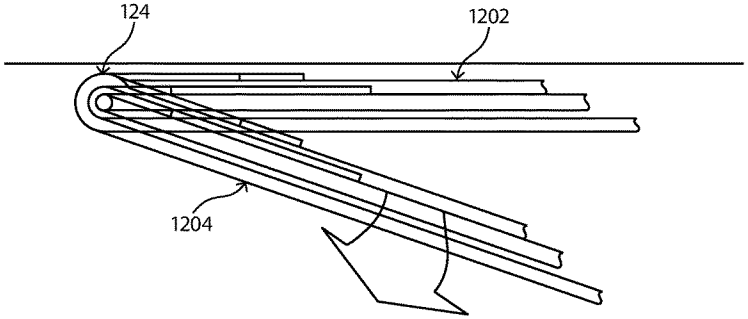
FIGS. 12A-12B illustrate exemplary embodiments of a hinged panel assembly.
Figure 12A:
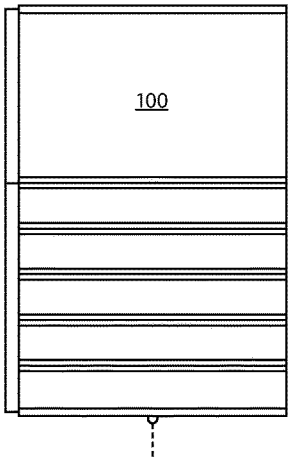

FIG. 12 shows an illustrative embodiment of signage panel assembly 100 comprising hinge 124, as discussed above in connection with FIG. 1 and FIG. 10G. As can be seen from the figure, hinge 124 allows a front portion 1202 to be separated from a rear portion 1204 to allow access to signage components (e.g., plaques, inserts, tabs, etc.).

Figure 13:
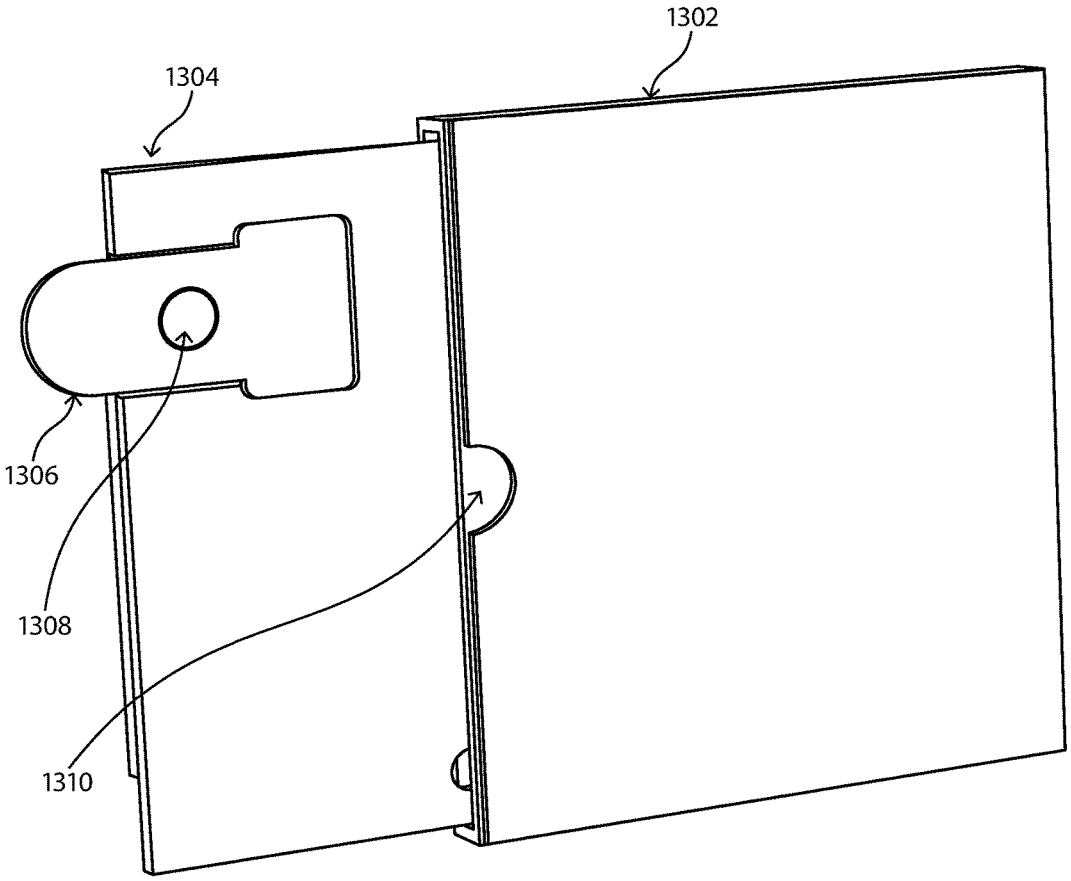
FIG. 13 illustrates an exemplary embodiment of a tabbed pocket assembly.

FIG. 13 illustrates one embodiment of a door insert window assembly (e.g., assembly 114) comprising a pocket portion 1302 that may be able to accommodate signage inserts 1310 on a front face. In addition, pocket portion 1302 may accommodate pocket insert 1304 which may comprise one or more pull tabs 1306 secured via pocket insert tab lock 1308. Pocket insert 1304 may comprise further signage, or preferably comprise documentation that may be removed from insert 1304. For example, medical charts, patient documentation, and any other type of physical document may be inserted and removed from pocket insert 1304.

Figure 14A:
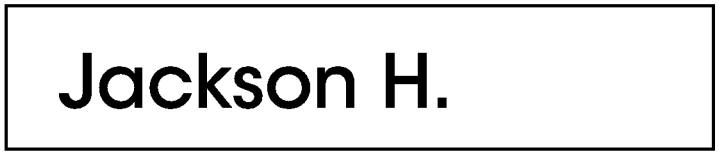
FIGS. 14A-14B illustrate an exemplary header pocket insert together with various exemplary insert content tabs suitable for use in an insert windows.
Figure 14B:
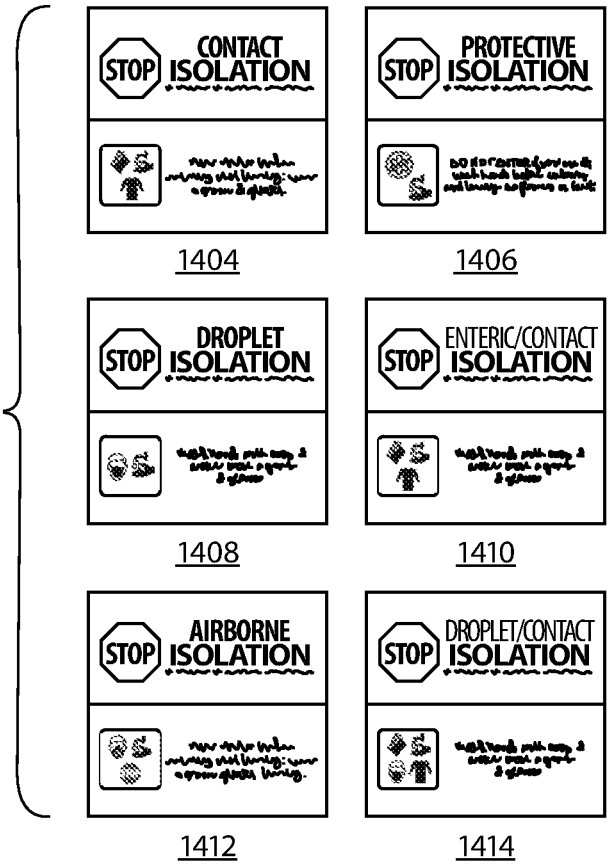

FIGS. 14A-15 illustrate various signage content that may be inserted and/or used for slidable tab content under various embodiments. In the exemplary embodiment of FIG. 14A a name plate insert 1402 is shown that is suitable for insert window 110 of other signage portions. The different embodiments of FIG. 14B show illustrative content that may be used for slidable tabs discussed herein. FIG. 15 show further illustrative content for slidable tabs. Those skilled in the art understand that these embodiments are non-limiting and that any of a variety of content may be used for this purpose.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiments.

What is claimed is:

1. A signage assembly, comprising:

a slider panel assembly comprising a back plate, the back plate further comprising a plurality of slider portions, each of the slider portions comprising, a groove for accepting a slidable tab, and a guidance tongue formed from a portion of the back plate, the guidance tongue comprising a locking mechanism and is formed from a portion of the back plate; and at least one front panel slidably attached to the back plate;

wherein the lock mechanism is configured to mate with a lock pocket of the slidable tab when the slidable tab is fully extended away from the back plate; and wherein each of the slider portions is covered by the at least one front panel.

2. The signage assembly of claim 1, wherein the guidance tongue is configured to flex in a direction suitable to allow insertion of a slidable tab with reduced interference from the lock mechanism.

3. The signage assembly of claim 1, wherein the front panel comprises a door insert window assembly comprising a pocket portion configured to receive content inserted into the pocket portion.

4. The signage assembly of claim 1, wherein the signage assembly further comprises a top and bottom channel suitable for allowing the at least one front panel to be slidably moved.

5. The signage assembly of claim 1, further comprising a header panel portion for receiving visual indicia, the header panel configured above the slider panel assembly.

6. The signage assembly of claim 1, further comprising a mounting panel suitable for affixing the signage assembly to a wall.

* * * * *